US007796086B2

(12) United States Patent
Coskun et al.

(10) Patent No.: US 7,796,086 B2
(45) Date of Patent: Sep. 14, 2010

(54) ANTENNA AND METHOD OF MANUFACTURING AN ANTENNA

(75) Inventors: Orhan Coskun, Izmir (TR); Ayse Sevinc Aydinlik Bechteler, Izmir (TR)

(73) Assignee: Vestel Elektronik Sanayi ve Ticaret A.S., Manisa (TR)

( * ) Notice: Subject to any disclaimer, the term of this patent is extended or adjusted under 35 U.S.C. 154(b) by 202 days.

(21) Appl. No.: 12/118,427

(22) Filed: May 9, 2008

(65) Prior Publication Data

US 2009/0015484 A1 Jan. 15, 2009

Related U.S. Application Data

(60) Provisional application No. 60/938,607, filed on May 17, 2007.

(51) Int. Cl.
*H01Q 1/38* (2006.01)
*H01Q 1/48* (2006.01)

(52) U.S. Cl. ..... 343/700 MS; 343/846

(58) Field of Classification Search ..... 343/700 MS, 343/702, 846

See application file for complete search history.

(56) References Cited

U.S. PATENT DOCUMENTS 6,664,926 B1 12/2003 Zinanti
7,183,981 B1 2/2007 Chao
7,450,072 B2 * 11/2008 Kim et al. ..... 343/700 MS
2002/0036897 A1 3/2002 Nakajima
2003/0151555 A1 8/2003 Holshouser
2007/0139270 A1 6/2007 Takei

FOREIGN PATENT DOCUMENTS

EP 1039576 9/2000
WO WO2005/048404 5/2005

OTHER PUBLICATIONS

European Search Report dated Jan. 24, 2008 for Application No. EP 07252019 (4 pages).

* cited by examiner

*Primary Examiner*—Hoang V Nguyen
(74) *Attorney, Agent, or Firm*—Conley Rose, P.C.

(57) ABSTRACT

An antenna (10) comprises a substrate (11) having a first and a second opposed side (12,13); a single element for radiating electromagnetic waves (15), wherein the radiating element (15) is formed on the first substrate side (12); a first ground plane (18) formed on the first substrate side (12), the first ground plane (18) being electrically connected to the radiating element (15); and, a second ground plane (19) formed on the second substrate side (13), the second ground plane (19) being electrically connected to the first ground plane (18).

19 Claims, 11 Drawing Sheets reference = 3.2 dBi

ANTENNA AND METHOD OF MANUFACTURING AN ANTENNA

CROSS-REFERENCE TO RELATED APPLICATIONS

This application claims the benefit of priority to U.S. application Ser. No. 60/938,607, filed May 17, 2007, the content of which is hereby incorporated by reference in its entirety for all purposes.

FIELD OF INVENTION

The invention relates to an antenna and to a method of manufacturing an antenna.

BACKGROUND

Wireless communication networks have served our communication needs well for over a century and are becoming increasingly prevalent in keeping people connected in metropolitan, wide, local and personal area networks. As the amount of information being sent and received in today's wireless communication systems has surged, a transition has occurred in the antenna, front end, baseband and network parts of a transceiver to efficiently use the bandwidth. By way of example, WiFi systems (wireless LANs based on the IEEE 802.11 specifications) provided 1 Mb/s connection speed in the physical layer, with a throughput of less than 0.5 Mb/s when they were first introduced. Now they are able to provide more than 200 Mb/s connection speed, with a throughput of 100 Mb/s or more. Driving this increase in speed are applications such as video conferencing, video streaming, multimedia content distribution, on-line training materials, cluster computing and data mining systems.

However, this increase in speed places greater demands on the performance of the antennas in the wireless communication systems, which are often and increasingly required to perform in systems where the space for antennas is strictly limited. Furthermore, in such systems the electrical performance of the antennas is strongly influenced by the environment in which it is required to operate. For example, the antenna may be mounted close to the housing of the communication device or to various other parts of the communication device, leading to the reflection of electromagnetic waves radiated by the antenna and consequentially to distortion of the radiation pattern in free space of the antenna, all of which negatively impacts the performance of the antenna. As a result, it is commonly necessary to redesign a known antenna type so as to be suitable for the specific environment in which it is intended to operate. This leads to additional time and cost being incurred in manufacturing the devices of the communication system. Thus, increasingly, known antennas are becoming inadequate for the task.

FIGS. 1A and 1B show a typical prior art antenna 100 used in a wireless communication system, viewed from the front and from the rear respectively. The antenna 100 comprises a substrate 101 of a thickness of about 0.3 mm. As shown in FIG. 1A, a metallic radiating element 102 and ground plane 103 are positioned on the front side of the substrate 101. As shown in FIG. 1B, a cable 104 is attached to the rear side of the substrate 101, by which signals are fed to and/or received from the antenna 100.

According to a first aspect of embodiments of the invention, there is provided an antenna, the antenna comprising: a substrate having a first and a second opposed side; a single element for radiating electromagnetic waves, wherein the radiating element is formed on the first substrate side; a first ground plane formed on the first substrate side, the first ground plane being electrically connected to the radiating element; and, a second ground plane formed on the second substrate side, the second ground plane being electrically connected to the first ground plane.

Because the antenna has ground planes on both sides on the substrate, the antenna is very flexible. For example, the antenna can be mounted with either side to the housing of a communication device, e.g. to the system ground chassis of a television set. The antenna is capable of being implemented in a variety of environments in a communication system whilst giving satisfactory electrical performance. This increases the flexibility of the antenna in how the antenna can be incorporated into a communication device, helping avoid the need to redesign an antenna to perform satisfactorily according to the communication device in which the antenna is employed. This is particularly useful in a mass production environment.

The preferred embodiment is applicable to a variety of wireless communication systems, for example computer-to-computer or computer-to-television communications.

In a preferred embodiment, one or more of the radiating element, the first ground plane and the second ground plane is a metal layer on the surface of the substrate. This allows for simple manufacture using standard "printing" or "etching" techniques known in the art.

In an embodiment, the first ground plane at least partially overlies the second ground plane.

In a preferred embodiment, the first ground plane substantially fully overlies the second ground plane. This improves the electrical performance of the antenna.

In an embodiment, at least one of the first and second ground planes has a height of substantially $\lambda/2$, wherein $\lambda$ is the wavelength of a electromagnetic wave at the resonant frequency of the antenna. This arrangement allows the antenna to provide its own ground plane, where for example there is no system ground to which the antenna can be attached.

Preferably, the first and second ground planes are connected by at least one via. Vias offer a simple way of making connection between the two ground planes, allowing known circuit board manufacturing techniques to be used in making the antenna. This helps allow the antenna to be mass manufactured simply and at relatively low cost.

Preferably, the first and second ground planes are connected by a plurality of vias separated by a maximum distance $d(max)=\lambda/10$, wherein $\lambda$ is the wavelength of an electromagnetic wave at the resonant frequency of the antenna. This helps achieve a good electrical connection between the ground planes and helps avoid possible resonance at the frequency band of interest.

The radiating element may be an inverted-F shape.

In an embodiment, the substrate is at least 1 mm thick. In another embodiment, the substrate is at least 3 mm thick. The preferred thick substrate between the ground planes helps improve the electrical performance of the antenna when mounted close to reflective structures such as the housing of a communication device in which it is employed.

According to a second aspect of embodiments of the invention, there is provided in combination, an electromagnetic wave processing apparatus and an antenna as described above, the antenna being arranged to transmit and/or receive the electromagnetic wave and the processing apparatus being arranged to process the electromagnetic wave.

In an embodiment, the apparatus has an electrically insulating outer housing and an electrically conducting inner chassis, and the antenna is mounted to said inner chassis. The antenna can be mounted with either side facing the housing in this embodiment, with little effect on the electrical performance of the antenna. This makes the antenna more flexible in the how it can be positioned in or on the apparatus.

In another embodiment, the apparatus has an electrically insulating housing, and the antenna is mounted to said housing such that the second substrate side faces the housing. This allows the radiating element of the antenna to be separated from the housing by the thickness of the substrate, whilst having a ground plane against the housing. This helps reduce the influence of the housing on the performance of the antenna.

In yet another embodiment, the apparatus has an electrically insulating housing, the housing having an inwardly protruding boss, wherein the antenna is mounted to said boss. This allows the antenna to be mounted at a desired distance from the housing, helping reduce reflection from the housing.

In embodiments, at least one of the first and second ground planes of the antenna are electrically connected to a ground of the apparatus. This has the effect of increasing the ground plane of the antenna beyond the extent of the ground planes formed on the substrate. In environments with a very limited space, by electrically connecting either ground plane of the antenna to the system ground this allows the ground plane area of the antenna and therefore the total size of the antenna to be kept small.

In embodiments, the combination provides a television set. In other embodiments, the combination provides a wireless communication system.

According to a third aspect of embodiments of the invention, there is provided a method of manufacturing an antenna, the method comprising: forming on a first surface of a substrate an element for radiating electromagnetic waves and a first ground plane, the first ground plane being electrically connected to the radiating element; forming on a second surface of the substrate a second ground plane, the second ground plane being electrically connected to the first ground plane, wherein the second surface of the substrate is opposed to the first surface of the substrate and wherein said radiating element is the only radiating element formed on the substrate.

In an embodiment, at least one of said radiating element, said first ground plane and said second ground plane is formed by patterning a metal deposited on the substrate. This provides a simple way of manufacturing the antenna, using known manufacturing techniques from the field of printed circuit boards.

The method may comprise forming the radiating element to be an inverted-F shape. The method may comprise forming the first ground plane to substantially fully overlie the second ground plane. In an embodiment, at least one of the first and second ground planes has a height of substantially $\lambda/2$, wherein $\lambda$ is the wavelength of a electromagnetic wave at the resonant frequency of the antenna.

BRIEF DESCRIPTION OF THE DRAWINGS

Embodiments of the invention will now be described by way of example with reference to the accompanying drawings, in which.

Parts of the following discussion are with reference to an antenna that is radiating electromagnetic energy, i.e. when acting as a transmitter. However, as will be appreciated by a person skilled in the art, much of this discussion will be equally applicable when the antenna is acting as a receiver.

Figure 2:
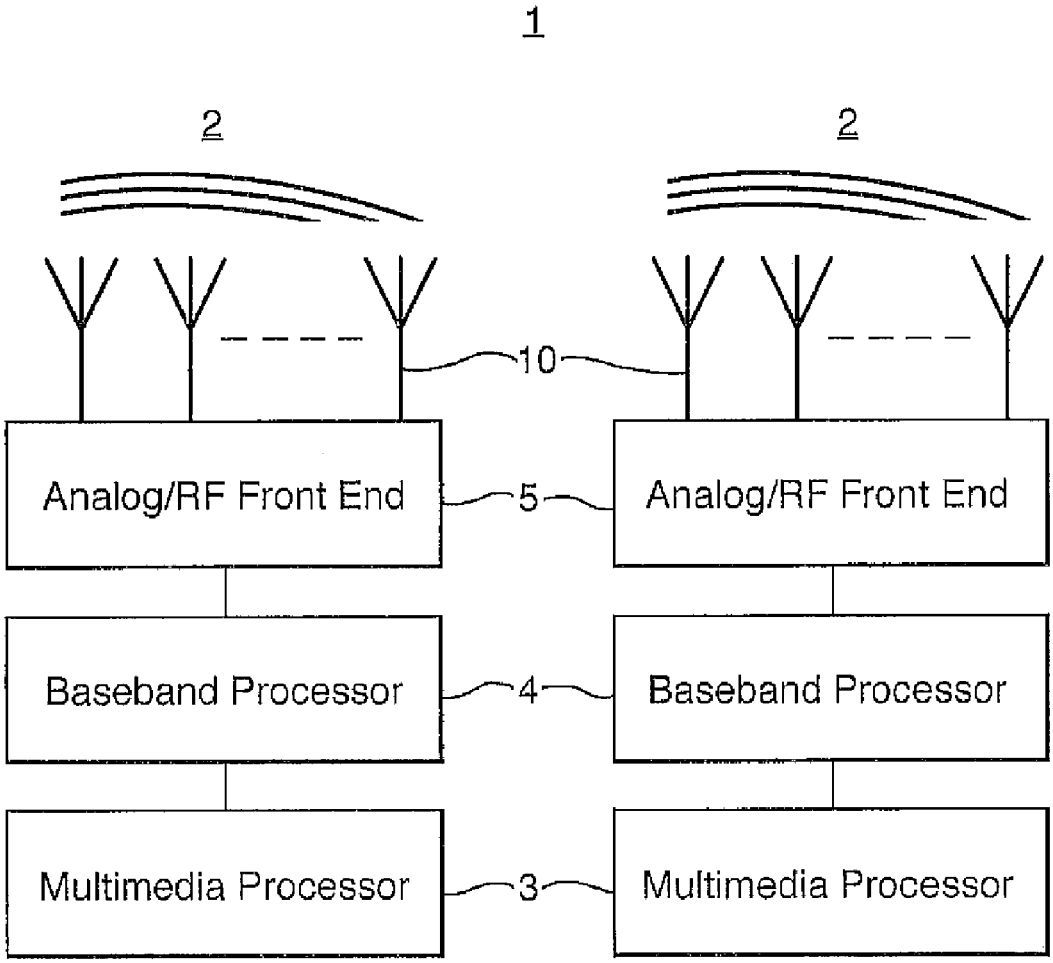
FIG. 2 shows a block diagram of a wireless multimedia communication system.

FIG. 2 shows a block diagram of a wireless multimedia communication system 1. The communication system 1 comprises a first and second communication device 2. Each communication device 2 has a multimedia processor 3 which generally handles top level functionality in the communication device 2, for example processing and presenting the multimedia information to the user. When transmitting, the multimedia processor 3 passes multimedia information to a baseband processor 4 which converts data to a form suitable for the wireless communication channel. This data is passed to an analogue/radio frequency front end 5 that is arranged to drive an antenna 10, thereby propagating the information as electromagnetic waves through space. A similar process is carried out in reverse when the communication device 2 acts as a receiver.

Figure 3:
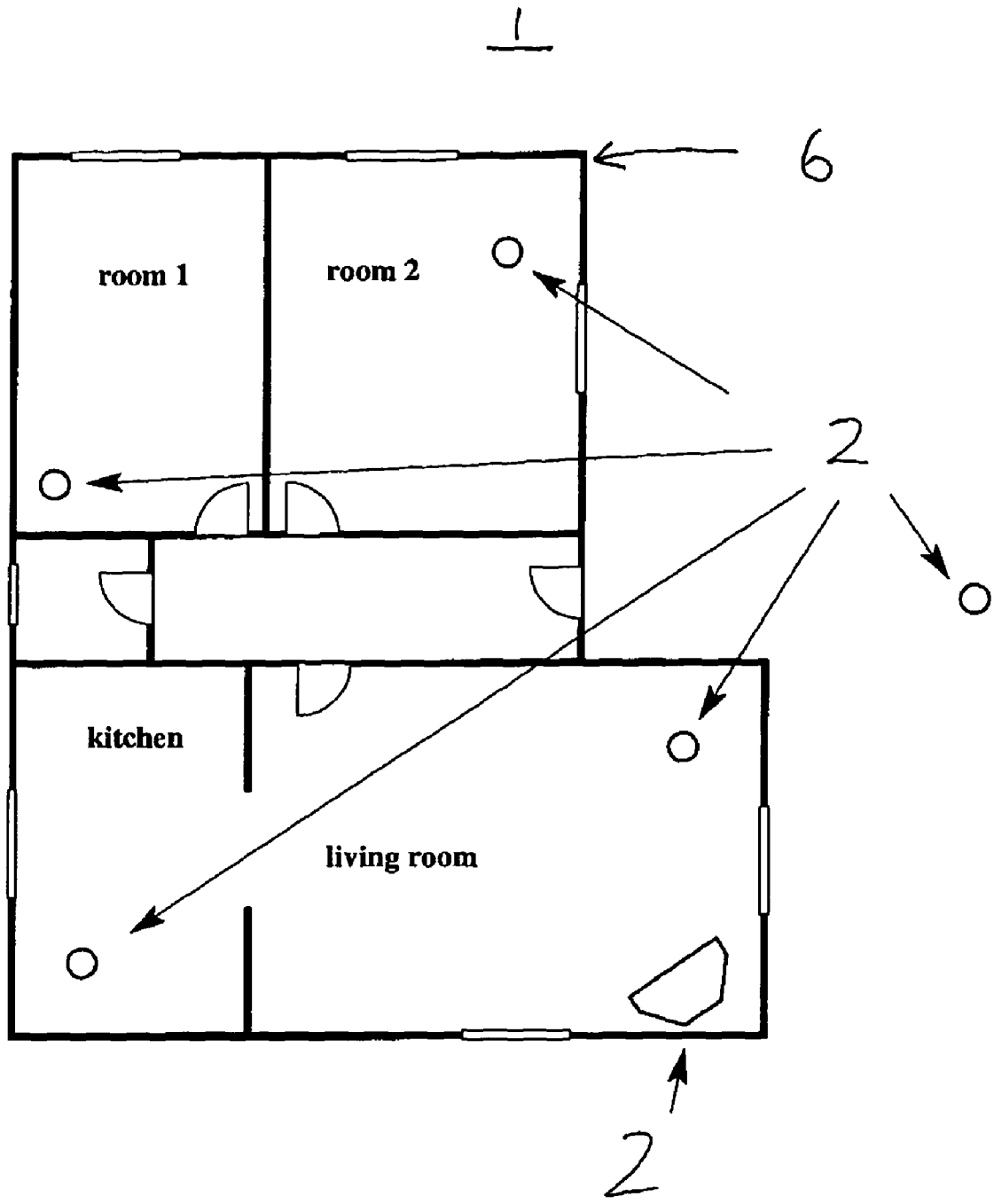
FIG. 3 shows an example of the plan of a house where a wireless communication system is installed.

FIG. 3 shows an example of the plan of a house 6 in which a wireless communication system 1 such as the one shown in FIG. 2 is implemented. Communication devices 2, which may be for instance computers or home entertainment equipment, are positioned at various positions in the plan 6. The communication devices 2 can be stationary or mobile, or can vary between being stationary and mobile. A typical application may be a wireless LAN implemented between a computer and one or more television sets, to allow content obtained by the computer to be sent to the television set for display.

It is generally desirable for the links of a communication system 1 to have a transfer rate that is as high as possible at all times. Since the location of each communication device 2 is a priori not known when the communication devices 2 are manufactured, and since a communication device 2 may be mobile, in which case the location of a communication device 2 may change with time, the antennas 10 of the communication devices 2 should ideally show an omni-directional radiation pattern. By aligning the phase between antennas 10, directional gain may be achieved. By combining the received signals on each antenna 10 in suitable way, for example using maximum ratio combining, a system may be provided that is more robust against fading.

Figure 4A:
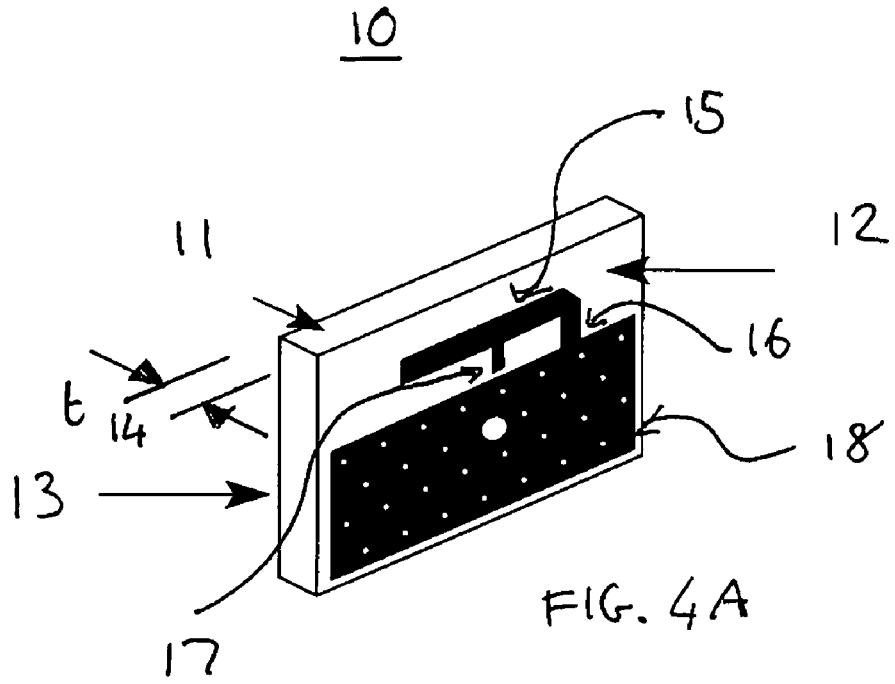
FIGS. 4A, 4B and 4C show an example of an antenna according to one embodiment of the invention viewed from the front, top and side, from the front, and from the rear respectively.
Figure 4B:
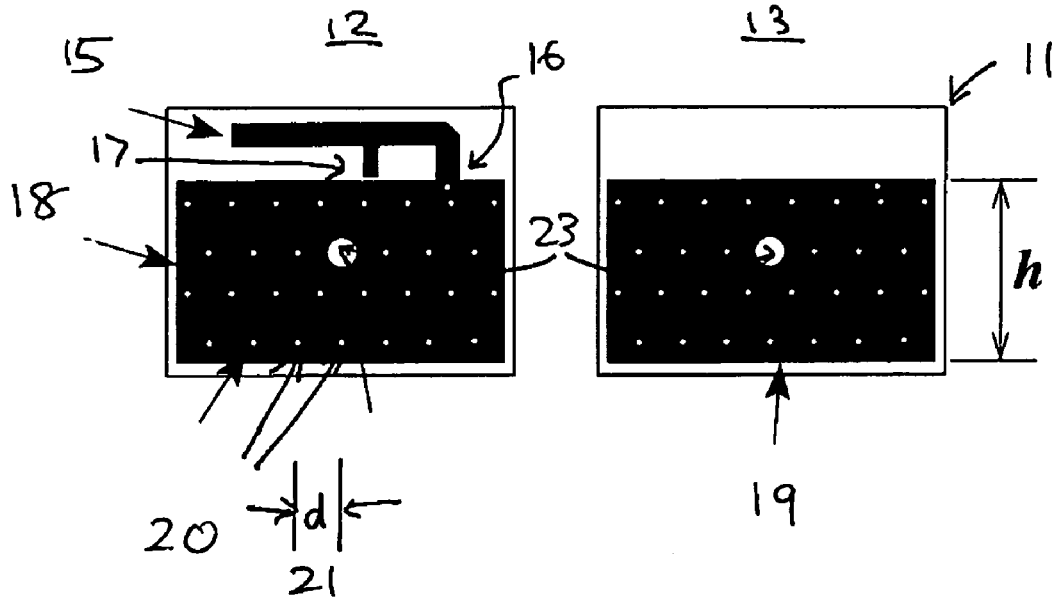
Figure 4C:
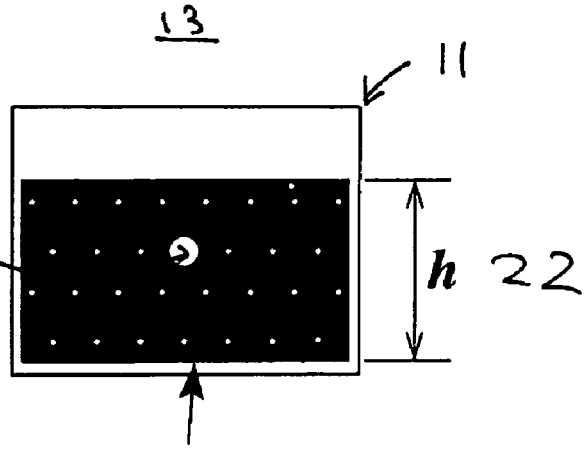

FIGS. 4A, 4B and 4C show an example of an antenna 10 according to one embodiment of the invention viewed from the front, top and side (FIG. 4A), from the front (FIG. 4B), and from the rear (FIG. 4C). The antenna 10 comprises a substrate 11 made from a material which has low electrical losses at the frequency range at which the antenna 10 is intended to operate. The substrate 11 has a thickness 14 which may be selected according to the application of the antenna 10. The thickness 14 of the substrate 11 is generally expected to be at least 1 mm and up to several mm. A thickness 14 of about 1.5 mm may be generally preferred.

The antenna 10 in this example is an inverted-F antenna. A radiating element 15 in the shape of an inverted-F is located on the front side 12 of the substrate 11, made from an electrically conducting metal such as, for example, copper. The radiating element 15 has a feed point 17 to which a driving signal is fed to the antenna 10 to be radiated into space. The driving signal may be supplied via a coaxial cable or other suitable cable attached to the feed point 17 of the antenna 10 (shown by FIGS. 6A, 6B, 7A and 7B and described further below). The radiating element 15 has a shorted foot portion 16, which is contiguous with or otherwise connected to a first ground plane 18 also located on the front side 12 of the substrate 11. The first ground plane 18 is also made of a conducting metal such as, for example, copper.

On the rear side 13 of the substrate 11, a second ground plane 19 is located. The second ground plane 19 is also made of a conducting metal such as, for example, copper. In this example, the first and second ground planes 18,19 have substantially the same footprint on the opposed front and rear sides 12,13 of the substrate 11, i.e. they substantially fully overlie each other. The ground planes 18,19 have a height h 22. The height h 22 of the ground planes 18,19 can be selected according to the application of the antenna 10 as discussed further below.

The antenna 10 may be manufactured by a standard "printing" technique as known in the art. For example, metal may be deposited on both sides 12,13 of a substrate 11. A wet-etching process may then be used to form or "pattern" the radiating element 15 and ground planes 18,19 by removing portions of the metal. This makes the antenna 10 particularly suitable for mass production. Nonetheless, other suitable ways of manufacturing the antenna 10 may be used.

The front and rear ground planes 18,19 located on the front and rear sides 12,13 of the substrate 11 are connected to each other by a plurality of vias 20 spaced across the extent of the ground planes 18,19. The distance d 21 between the vias 20 is selected in accordance with the frequency f at which the antenna 10 is intended to operate. In order to guarantee a good electrical connection between the two ground planes 18,19, and in order to avoid possible resonance at the frequency band of interest, the maximum distance between vias 20 is preferably given as follows:

$$d_{max}=\lambda/10=c/(10\times f)$$

where d represents the distance between two neighbouring vias 20, c is the speed of light, f is the specified frequency at which the antenna 10 is intended to operate, and λ is the wavelength corresponding to the specified frequency.

Thus, where the antenna is intended to operate at a frequency of 2.45 GHz, the distance between vias 20 is preferably no more than:

$$= 3\times10^{8}\ \mathrm{ms}^{-1}/(10\times2.45\times10^{9}\ \mathrm{Hz})$$

$$= \textit{approx.}\ 1.2\ \mathrm{cm}$$

A mounting hole 23 is provided through the antenna 10, extending through both ground planes 18,19 and the substrate 11, allowing the antenna 10 to be mounted to a convenient attachment point of a communication device 2. The mounting hole 23 can be located anywhere within the area of the ground planes 18,19 as convenient to allow the antenna 10 to be mounted.

Figure 5A:
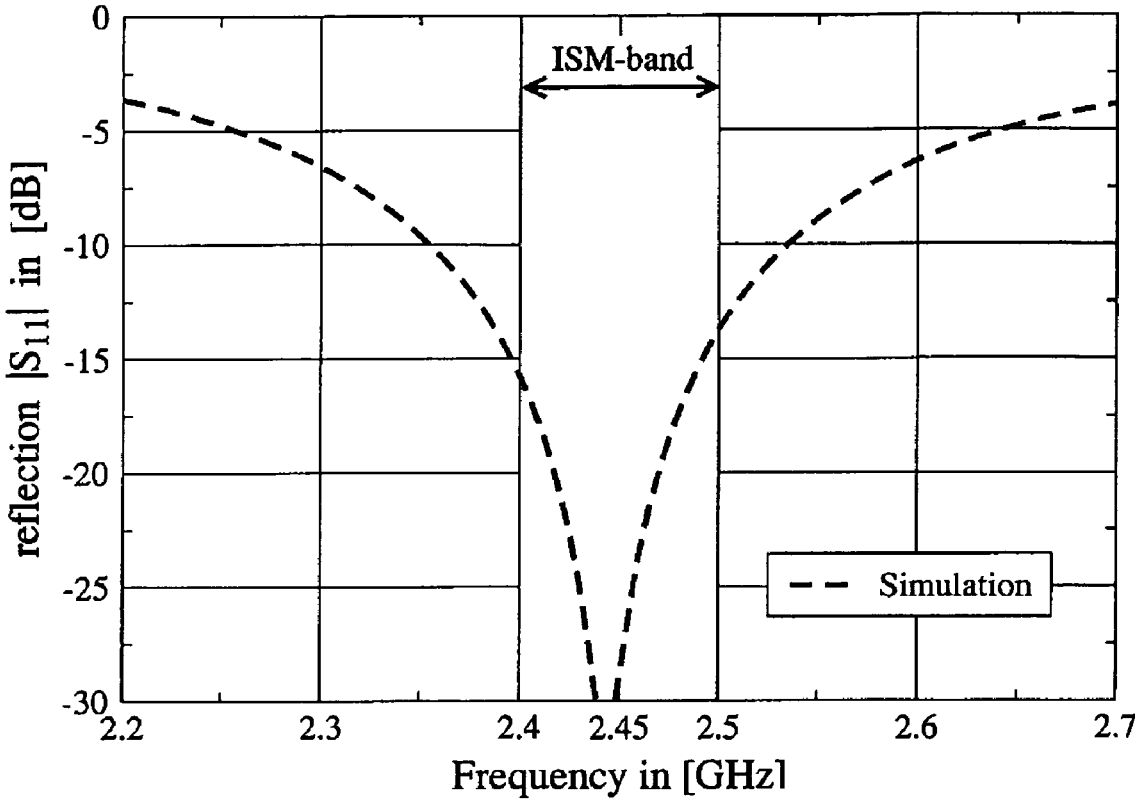
FIG. 5A shows an example of the simulated reflection coefficient of the antenna of FIGS. 4A, 4B and 4C.

FIG. 5A shows a graph measuring the reflection coefficient of the antenna 10 against signal frequency, as determined by a simulation of the performance of the antenna 10. The simulation may be made by, for example, a suitable computer application. As is generally known, when driving an antenna 10 with an input signal, i.e. when the antenna 10 is operating as a transmitter, a proportion of the input signal energy may be reflected back from the antenna 10, rather than being transferred to the antenna 10 and then radiated into space. The reflection coefficient gives a measure of the proportion of power that is reflected by the antenna 10 and thus gives an indication as to the performance of the antenna 10.

It is generally desirable that the antenna 10 has a low reflection coefficient, at least over the frequency range of interest, so that the performance of the antenna 10 is acceptably efficient. A generally recognised "rule-of-thumb" in the field of antenna manufacturing is that a reflection coefficient of no more than about −10 dB throughout the frequency band of interest is sufficient to give acceptable operation of the antenna 10. This means that no more than 10% of the power of the input signal fed to the antenna 10 is reflected back in the transmission line, rather than being transferred to the antenna 10 and then radiated into space.

The antenna 10 of present example is arranged to operate in the ISM frequency band, i.e. over a frequency range of 2.4 to 2.5 GHz. Accordingly, the antenna 10 is arranged to resonate at the centre frequency in this range, i.e. 2.45 GHz, by for example sizing and shaping the radiating element 15 to resonate at this frequency. Thus, as can be seen from FIG. 5A, the reflection coefficient of the antenna 10 has its minimum value at an input signal frequency of 2.45 GHz. The minimum value may be as low as −50 dB at this point. Within the frequency band of 2.4 to 2.5 GHz, the reflection coefficient is lower than −10 dB throughout the frequency band.

Figure 5B:
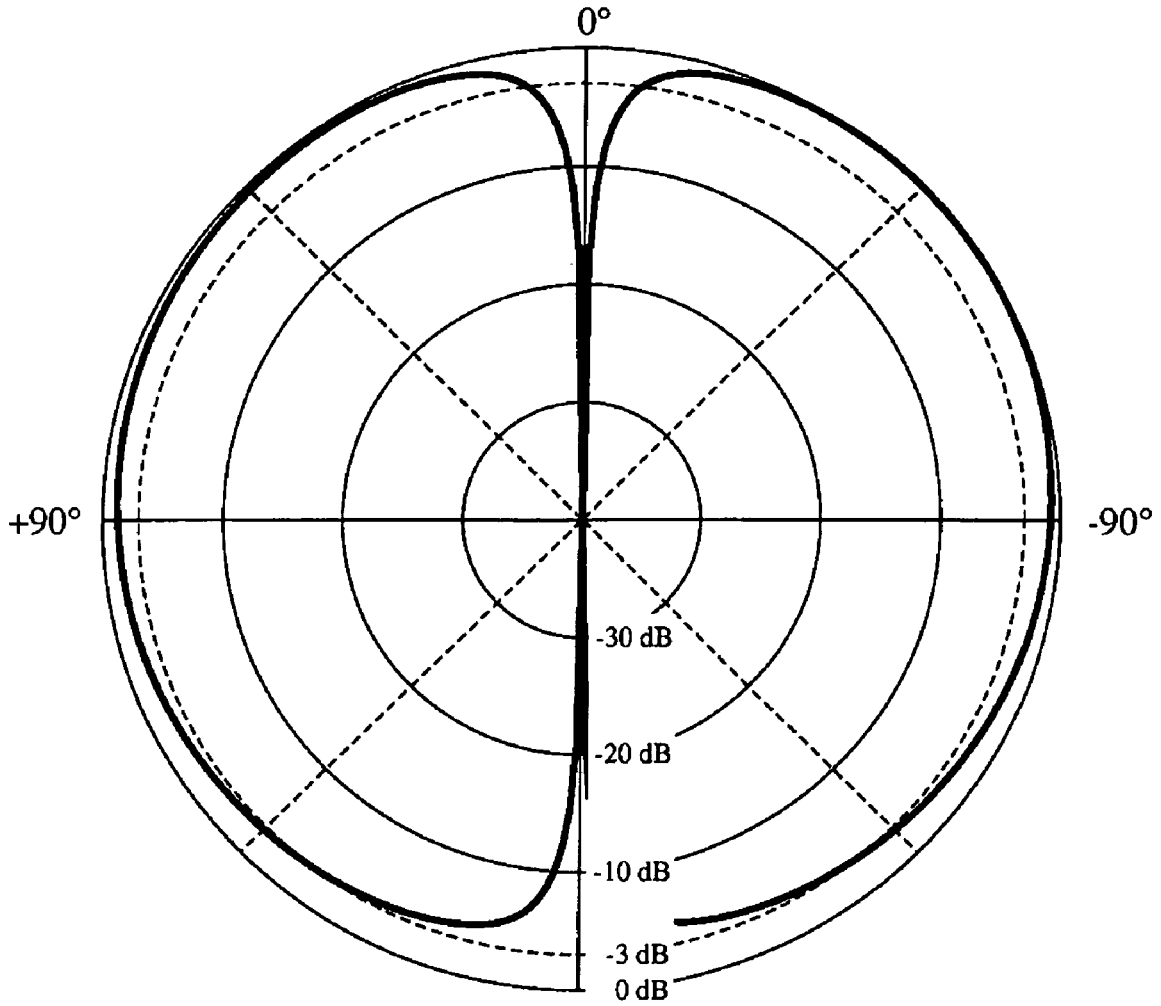
FIG. 5B shows an example of the simulated radiation pattern in free space of the antenna of FIGS. 4A, 4B and 4C.

FIG. 5B shows the simulated radiation pattern of the same antenna 10. The radiation pattern shows nearly omni-directional behaviour as required in many wireless communication systems 1.

Figure 1A:
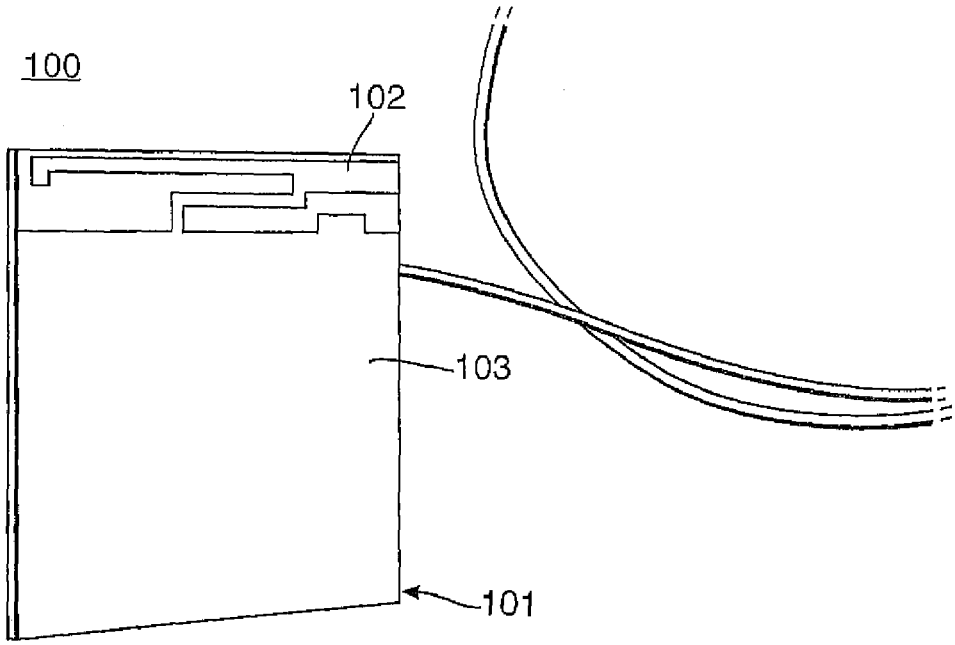
Fig.1A. (Prior Art)
FIGS. 1A and 1B show a typical prior art antenna used in a wireless communication system, viewed from the front and from the rear respectively.
Figure 1B:
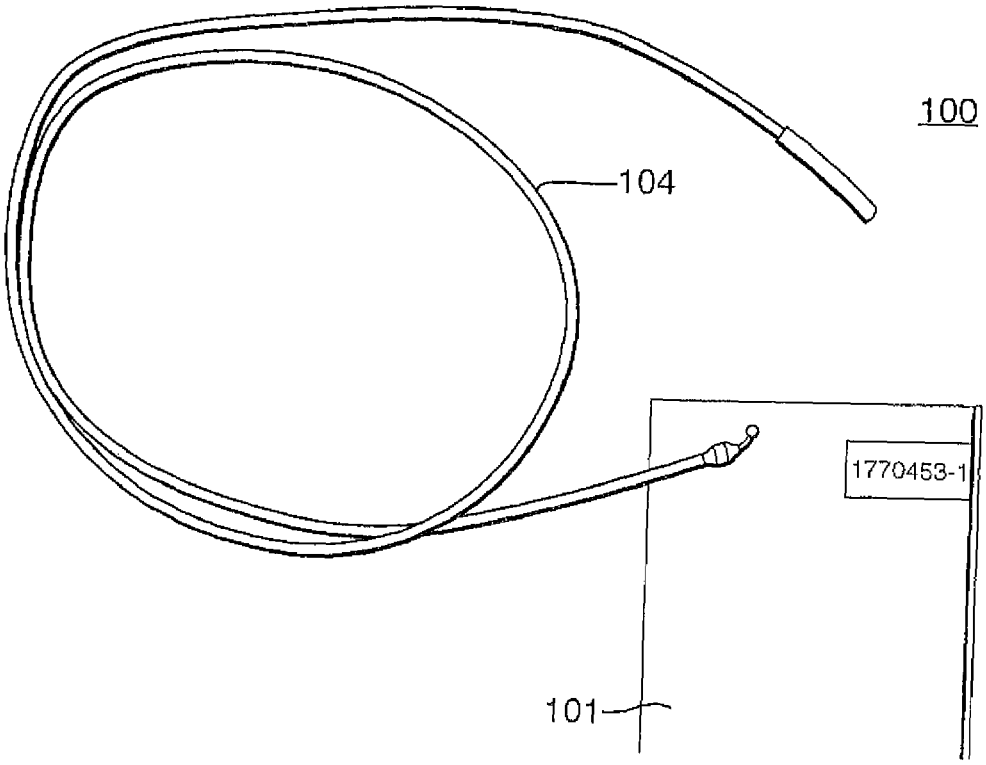
Fig.1B. (Prior Art)

The simulated results of the antenna 10 are substantially similar to those that would be achieved by a prior art inverted-F antenna. Examples of prior art arrangements of inverted-F antennas include an antenna with a single radiating element and a single ground plane located on one side of the substrate (as shown in FIGS. 1A and 1B for example), and an antenna with a radiating element and a ground plane each located on both sides of the substrate.

As a person skilled in the art will realise, the environment in which an antenna 10 is employed has a significant influence in practice on the performance of that antenna 10. Examples of such environmental factors include the proximity of the antenna 10 to interfering structures, such as the housing of the communication device 2, and electrical losses in the various conductors or substrate 11. This means that in practice the measured values of the reflection coefficient of the antenna 10 when employed in a communication system 1 will be different from the simulated values, and will in general be lower. Furthermore, this means that the measured values will be different for a particular antenna 10 when employed in different communication devices 2 and when mounted in different ways within a communication device 2. As will be described further in the following, the present antenna 10 advantageously shows more consistent performance when employed in different communication devices 2, making the antenna 10 more versatile in comparison with other prior art antennas.

Figure 6B:
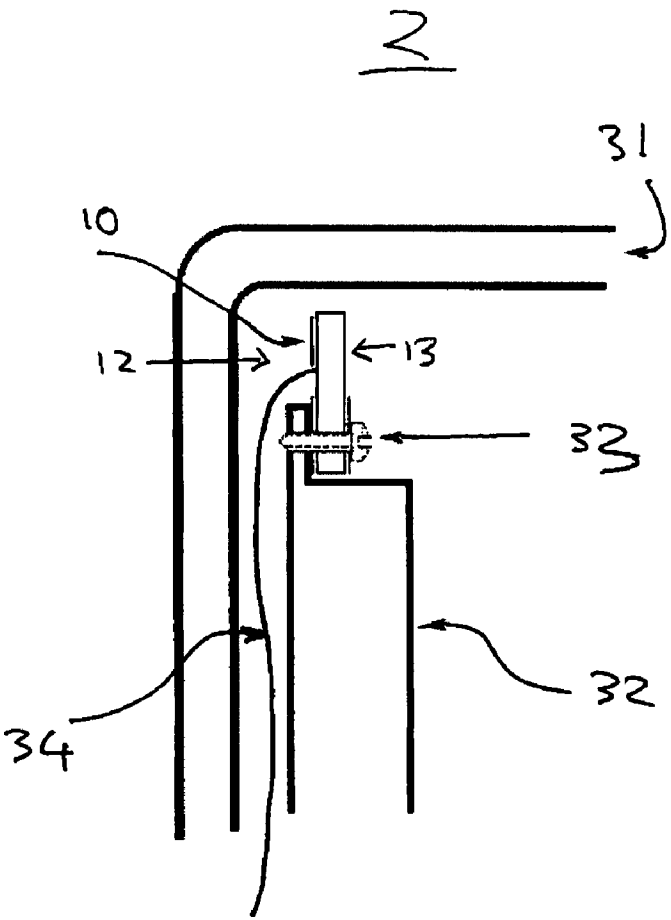
FIGS. 6A and 6B show examples of a mounting scheme of the antenna of FIGS. 4A, 4B and 4C inside a housing of a communication device.
Figure 6A:
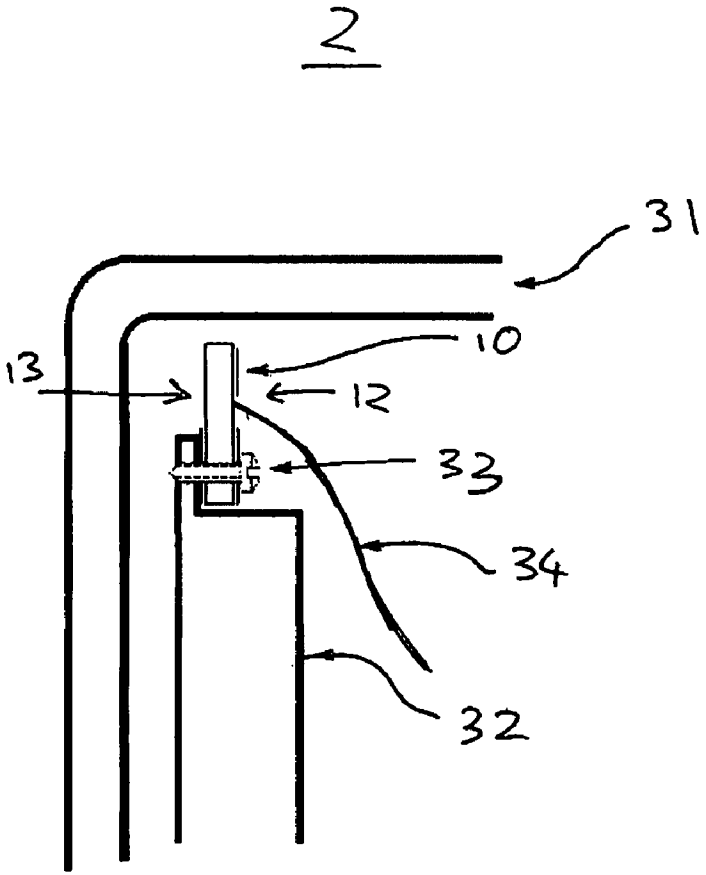

FIGS. 6A and 6B show two examples of the present antenna 10 mounted inside a communication device 2 for use in a communication system 1 such as shown in FIG. 2. The communication device 2 may be, for example, a television set or part of a wireless device for a computer, allowing computer-to-computer or computer-to-television communications such as the example shown in FIG. 3. The communication device 2 has an electrically insulating outer housing 31. Typically this may be made from a plastics material. Inside the outer housing 31 is an electrically conducting inner chassis 32. Typically this may be made from a metal. The antenna 10 is mounted to the inner chassis 32 by a screw 33 or other fastener driven through the mounting hole 23 of the antenna 10. The antenna 10 is fed by a coaxial cable 34 or other cable attached to the feed point 17 of the antenna 10, by which a driving signal is fed to the antenna 10 from the analogue/radio frequency front end 5 (not shown in FIGS. 6A and 6B) of the communication device 2.

As is common in some communication devices 2, such as for example a television set, the conducting inner chassis 32 acts as a ground for the system. Thus, as in the cases shown in FIGS. 6A and 6B, the ground planes 18,19 of the antenna 10 are electrically connected to the conducting inner chassis 32 and are thereby connected to the system ground. This has the advantage of extending the effective depth of the ground planes 18,19 of the antenna 10, allowing the ground planes 18,19 of the antenna 10 to be made smaller, and thus the antenna 10 to be made smaller.

The antenna 10 can be mounted with either the front or rear side 12,13 facing the housing 31, as shown in FIGS. 6A and 6B respectively, with no or very little degradation of the electrical performance of the antenna 10. This is useful, as the feed point 17 of the antenna 10 is fixed in being on the front side of the antenna 10, and the antenna 10 can be mounted according to how it is convenient for the antenna cable 34 to be routed.

Figure 6C:
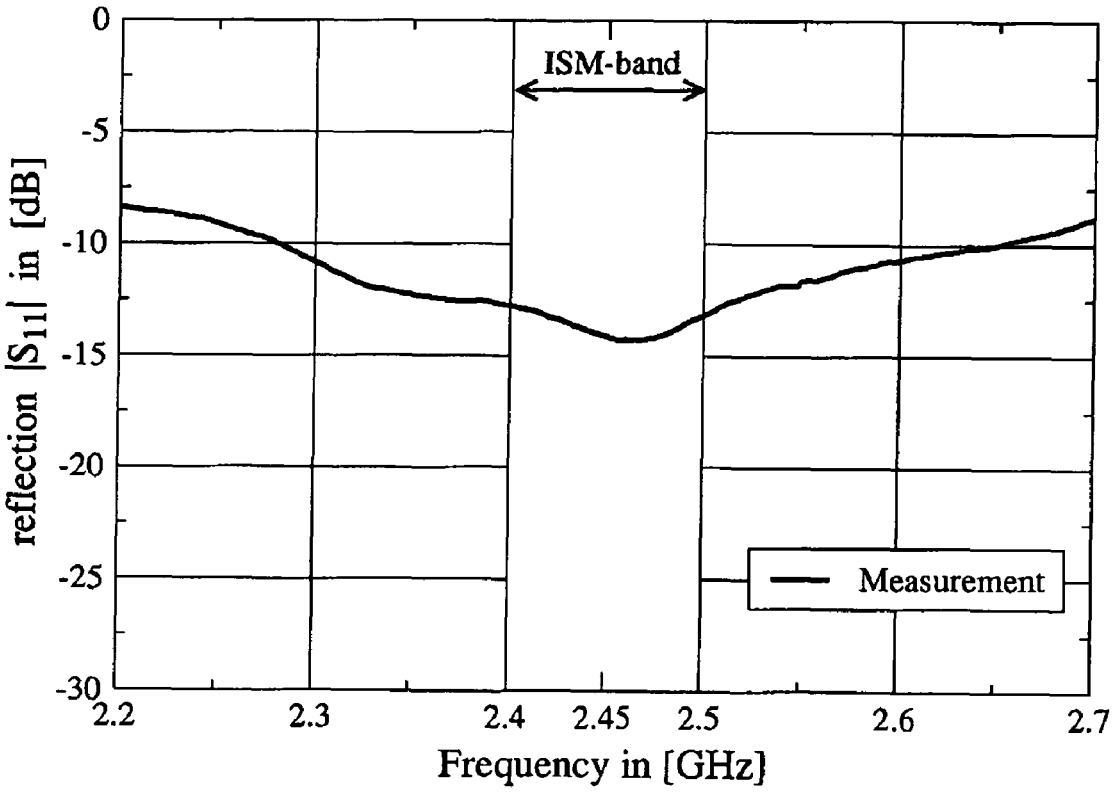
FIG. 6C shows an example of the measured reflection coefficient of the antenna mounted as shown in FIGS. 6A and 6B.

FIG. 6C shows the measured reflection coefficient of the antenna 10 mounted inside a communication device 2 as shown by FIG. 6A or 6B. Throughout the frequency band of interest, the reflection coefficient is lower than −10 dB and shows the same results when the antenna 10 is mounted with either side 12,13 facing the housing 31. This shows the versatility of the present antenna 10.

Figure 7A:
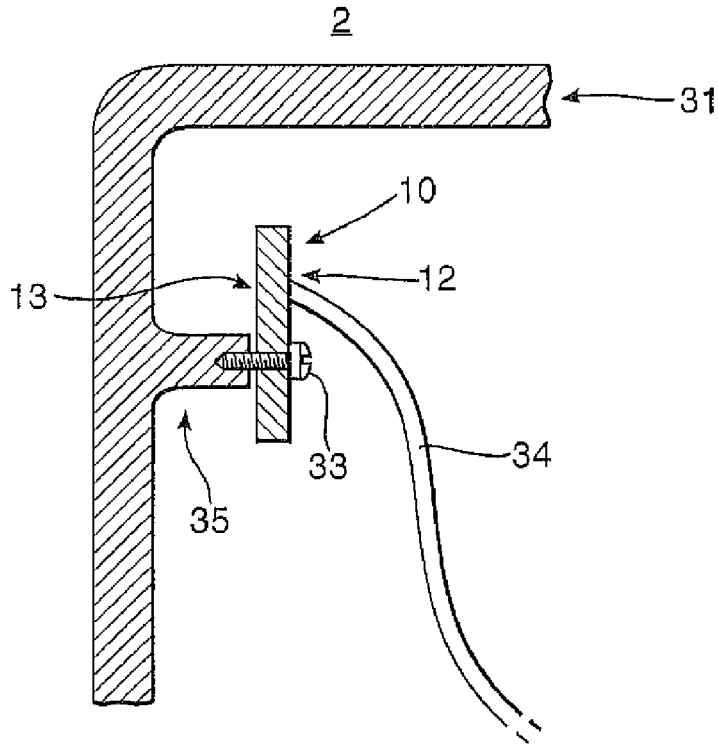
FIGS. 7A and 7B show further examples of a mounting scheme of the antenna of FIGS. 4A, 4B and 4C inside a housing of a communication device.
Figure 7B:
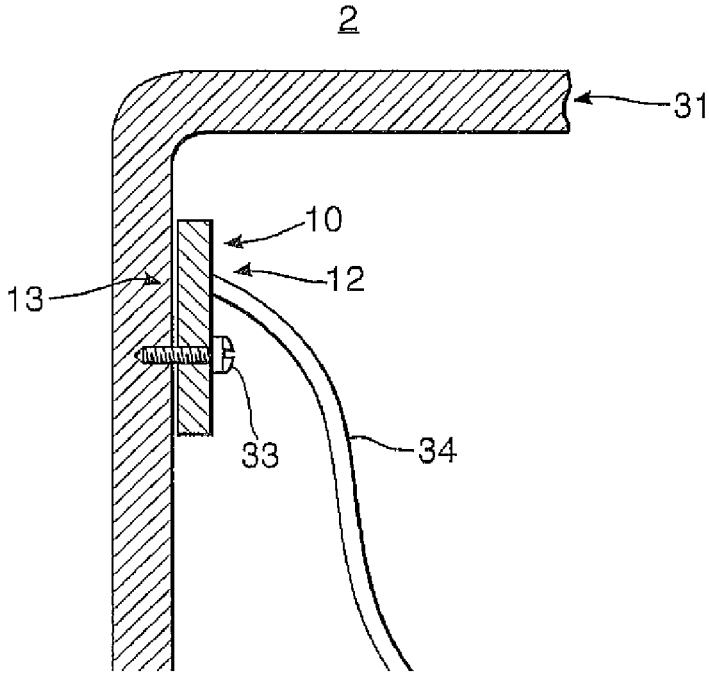

FIGS. 7A and 7B show two further examples of how the antenna 10 may be implemented inside a communication device 2. In these examples, the communication device 2 has an electrically insulating outer housing 31, for example made from a plastics material, to which the antenna 10 is mounted. In these examples, the communication device 2 does not have an electrically conducting inner chassis acting as a system ground. The antenna 10 therefore provides its own ground solely by way of the ground planes 18,19. This means that the height h 22 of the ground planes 18,19 must be larger to achieve a satisfactory performance of the antenna 10. The height h 22 selected for the ground planes 18,19 depends on the particular application of the antenna 10, and in particular on the frequency band at which it is intended to operate. It is generally preferred that the height h 22 of the ground planes 18,19 is at least equal to half of the wave length of the frequency of interest. By way of example, when operating over the ISM frequency band, which is centred on a frequency of 2.45 GHz, the preferred height h 22 is given as follows:

$$h=\lambda/2=c/(2\times\text{frequency})$$

where c is the speed of light, f is the specified frequency at which the antenna 10 is intended to operate, and λ is the wavelength corresponding to the specified frequency.

$$=3\times10^{8}\ \text{ms}^{-1}/(2\times2.45\times10^{9}\ \text{Hz})$$

$$=\textit{approx.}\ 6\ \text{cm}$$

As mentioned above in relation to FIGS. 6A and 6B, where the ground planes 18,19 are connected to the system ground, the height h 22 can be made smaller than the preferred height h 22 than otherwise, for example half the height.

In the example shown by FIG. 7A, the housing 31 has an inwardly-extending boss 35 to which the antenna 10 is mounted via the mounting hole 23 and a screw 33 or other fastener. This positions the antenna 10 at a distance of about 10 mm millimetres to the housing 31. This reduces the influence of the housing 31 on the performance of the antenna 10.

In the example shown by FIG. 7B, the antenna 10 is mounted directly onto the housing 31. The antenna 10 is mounted so that the radiating element 15 faces away from the housing 31. Thus, due to the thickness 14 of the substrate 11 of the antenna 10, a minimum distance is ensured between the radiating element 15 and the housing 31, namely the thickness 14 of the substrate 11. The thickness 14 of the substrate 11 ensures that the distance between the radiating element 15 of the antenna 10 and housing 31 is large enough to minimize the electrical influence of the housing 31 on the performance of the antenna 10 over the particular frequency band of interest. In this arrangement, the antenna 10 also has a ground plane, i.e. the rear ground plane 19, adjacent the housing 31, which also helps improve the electrical performance of the antenna 10.

Figure 7C:
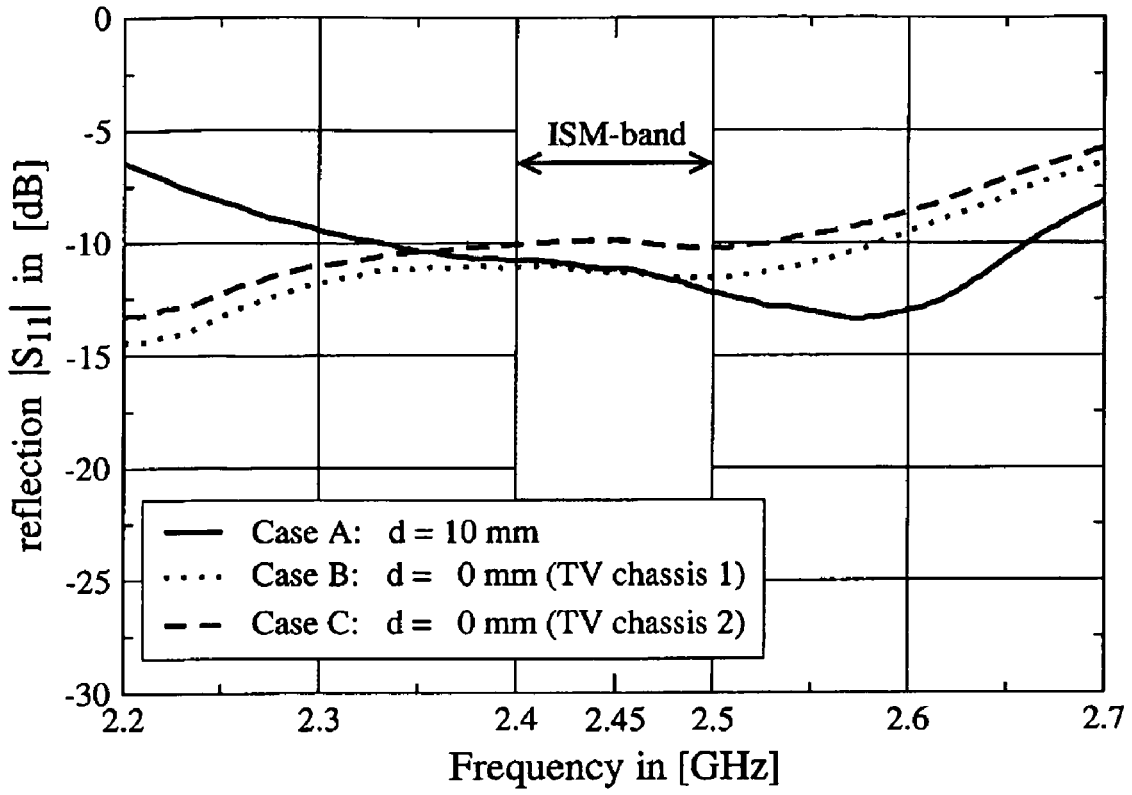
FIG. 7C shows an example of the measured reflection coefficient of the antenna mounted as shown in FIGS. 7A and 7B under various conditions; and, FIG. 7D shows an example of the measured reflection coefficient of a commercially available printed antenna mounted under various conditions.

FIG. 7C shows three cases of the measured reflection coefficient of the present antenna 10. In case A, the antenna 10 is mounted on a boss 35 with a distance of 10 mm to the housing 31 of a television. In case B, the antenna 10 is mounted directly on a housing 31 made of a certain plastic. In case C, the antenna 10 is mounted directly on another housing 31 made of a plastic different from the plastic used in case B. It can be seen that the electrical influence of the two different plastic materials in case B and case C on the electrical performance of the antenna 10 is small. The reflection is no higher than −10 dB in both cases. Further performed wireless connection tests proved the low influence of the housing 31 due to the preferred thick substrate 11.

Figure 7D:
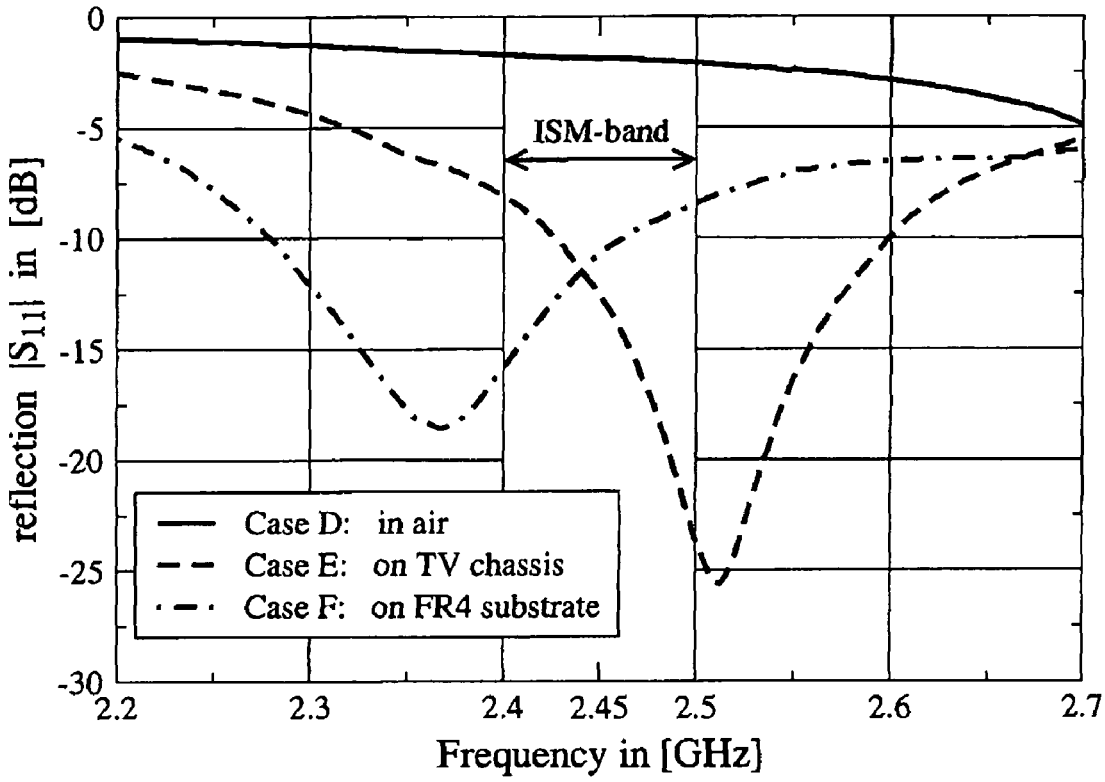

For comparison, FIG. 7D shows three examples of the measured reflection coefficient of a commercially available printed antenna, such as for example the antenna shown by FIGS. 1A and 1B, mounted under similar conditions as described above. The antenna has a theoretical minimum reflection coefficient at 2.45 GHz, i.e. in the centre of the ISM band. In case D, the antenna is mounted in air and shows a minimum reflection coefficient above 2.7 GHz. In case E, the antenna is mounted on the housing of a television set and shows a minimum reflection coefficient at 2.51 GHz. In case F, the antenna is mounted on FR4 substrate and shows a minimum reflection coefficient at 2.37 GHz. The influence of the environment, and in particular the housing, on the electrical performance of the antenna is clearly seen. In each case, the antenna is unable to achieve the desired standard of a reflection coefficient of no more than about −10 dB throughout the ISM frequency band.

This illustrates the types of problem involved with producing an antenna for use in a number of different mass-produced communication devices 2. For example, the housing of such a device is often made of a plastics material. However, the electrical properties of the plastics material may not be very well known. Also, the material from which the housing is made may be changed during the manufacturing lifetime of the product. Also, the electrical properties of the housing and the material from which it is made are often only known approximately, within a certain tolerance, and not very precisely. Any of these factors may mean that a commercially available antenna may not perform adequately when employed in a particular communication device, or may become not suitable during the manufacturing lifetime of the product as the specifications of that device change. As a result, the typical commercially available antenna often has to be redesigned according to the specific environment presented by the communication device 2 in which it is to be employed, in order that the performance of the antenna is acceptable in that environment. In contrast, the present antenna 10 is capable of being used within a wider range of environments without the need of being redesigned. This is advantageous where the antennas 10 and the communication devices 2 in which they are employed are being mass produced, since it is more time and cost effective.

A further advantage of antenna 10 is the mechanical stability it offers due to the preferred thick substrate 11. The antenna 10 can withstand higher mechanical stresses when mounted during the manufacturing process of the whole communication device 2, and when used in harsh environmental conditions.

It should be noted that antenna types other than an inverted-F antenna may be used. The inverted-F antenna is presently popular in communication systems that operate over the ISM band and in small devices generally. Nonetheless, many suitable types of antennas may be used: for example, a printed broadband monopole antenna may be used, or other printed antenna types. Similarly, other frequency bands may be used.

Embodiments of the invention have been described with particular reference to the examples illustrated. However, it will be appreciated that variations and modifications may be made to the examples described within the scope of the invention.

The invention claimed is:

1. An antenna, the antenna comprising:

a substrate having a first and a second opposed side;

a single element for radiating electromagnetic waves, wherein the radiating element is formed on the first substrate side;

a first ground plane formed on the first substrate side, the first ground plane being electrically connected to the radiating element; and, a second ground plane formed on the second substrate side, the second ground plane being electrically connected to the first ground plane, wherein the substrate is at least 1 mm thick.

2. An antenna according to claim 1, wherein one or more of the radiating element, the first ground plane and the second ground plane is a metal layer on the surface of the substrate.

3. An antenna according to claim 1, wherein the first ground plane at least partially overlies the second ground plane.

4. An antenna according to claim 1, wherein the first ground plane substantially fully overlies the second ground plane.

5. An antenna according to claim 1, wherein at least one of the first and second ground planes has a height of substantially $\lambda/2$, wherein $\lambda$ is the wavelength of a electromagnetic wave at the resonant frequency of the antenna.

6. An antenna according to claim 1, wherein the first and second ground planes are connected by at least one via.

7. An antenna according to claim 6, wherein the first and second ground planes are connected by a plurality of vias separated by a maximum distance $d(max)=\lambda/10$, wherein $\lambda$ is the wavelength of a electromagnetic wave at the resonant frequency of the antenna.

8. An antenna according to claim 1, wherein the radiating element is an inverted-F shape.

9. An antenna according to claim 1, wherein the substrate is at least 3 mm thick.

10. In combination, an electromagnetic wave processing apparatus and an antenna according to claim 1, the antenna being arranged to transmit and/or receive the electromagnetic wave and the processing apparatus being arranged to process the electromagnetic wave.

11. A combination according to claim 10, wherein the apparatus has an electrically insulating outer housing and an electrically conducting inner chassis, and the antenna is mounted to said inner chassis.

12. A combination according to claim 10, wherein the apparatus has an electrically insulating housing, and the antenna is mounted to said housing such that the second substrate side faces the housing.

13. A combination according to claim 10, wherein the apparatus has an electrically insulating housing, the housing having an inwardly protruding boss, wherein the antenna is mounted to said boss.

14. A combination according to claim 10, wherein at least one of the first and second ground planes of the antenna are electrically connected to a ground of the apparatus.

15. A method of manufacturing an antenna, the method comprising:

forming on a first surface of a substrate an element for radiating electromagnetic waves and a first ground plane, the first ground plane being electrically connected to the radiating element;

forming on a second surface of the substrate a second ground plane, the second ground plane being electrically connected to the first ground plane, wherein the second surface of the substrate is opposed to the first surface of the substrate and wherein said radiating element is the only radiating element formed on the substrate, wherein the substrate is at least 1 mm thick.

16. A method according to claim 15, wherein at least one of said radiating element, said first ground plane and said second ground plane is formed by patterning a metal deposited on the substrate.

17. A method according to claim 15, comprising forming the first ground plane to at least partially overlie the second ground plane.

18. A method according to claim 15, comprising forming at least one via to connect the first and second ground planes.

19. A method according to claim 18, comprising forming a plurality of vias to connect the first and second ground planes such that the vias are separated by a maximum distance $d(max)=\lambda/10$, wherein $\lambda$ is the wavelength of a electromagnetic wave at the resonant frequency of the antenna.

* * * * *